United States Patent [19]

Watanabe et al.

[11] 4,342,255

[45] Aug. 3, 1982

[54] OSCILLATOR ACTUATED HYDRAULIC IMPULSE DEVICE

[75] Inventors: Takeo Watanabe, Yokohama; Makoto Matsuda, Tokyo, both of Japan

[73] Assignee: Mitsui Engineering and Shipbuilding Co., Ltd., Tokyo, Japan

[21] Appl. No.: 202,139

[22] Filed: Oct. 30, 1980

Related U.S. Application Data

[63] Continuation of Ser. No. 11,438, Feb. 12, 1979, abandoned.

[51] Int. Cl.[3] ..... F15B 21/02; F01L 25/04; F01L 21/02

[52] U.S. Cl. ..... 91/40; 91/26; 91/240; 91/243; 91/278; 91/290; 91/321

[58] Field of Search ..... 91/40, 321, 460, 39, 91/290, 278, 240, 243

[56] References Cited

U.S. PATENT DOCUMENTS

| | | | |
|---|---|---|---|
| 1,822,667 | 9/1931 | Proell | 91/39 |
| 2,955,460 | 10/1960 | Stevens et al. | 91/40 |
| 2,965,076 | 12/1960 | Zeisloft | 91/40 |
| 3,552,269 | 1/1971 | Arndt | 91/321 |
| 3,908,767 | 9/1975 | Klemm | 91/321 |

FOREIGN PATENT DOCUMENTS

| | | | |
|---|---|---|---|
| 1300329 | 7/1969 | Fed. Rep. of Germany | 91/321 |
| 567408 | 10/1957 | Italy | 91/39 |

*Primary Examiner*—Paul E. Maslousky
*Attorney, Agent, or Firm*—Koda and Androlia

[57] ABSTRACT

An oscillator actuated hydraulic impulse of the type including a spool valve actuated by an alternating signal from an oscillator to switch the hydraulic pressure in a double acting cylinder in order to cause reciprocating motion of a piston which strikes a boring tool. The hydraulic impulse device further includes a means for controlling the transition from the impulse stroke to the return stroke of the piston. In some embodiments, the hydraulic impulse device may further include a means for varying the duration of the impulse stroke and the return stroke of the piston.

6 Claims, 21 Drawing Figures

OSCILLATOR ACTUATED HYDRAULIC IMPULSE DEVICE

This is a continuation of application Ser. No. 11,438, filed Feb. 12, 1979, now abandoned.

BACKGROUND OF THE INVENTION

1. Field of the Invention

This invention relates to oscillator actuated hydraulic impulse devices and in particular oscillator actuated hydraulic impulse devices which are provided with means for controlling the stroke of the piston which strikes a boring tool.

2. Prior Art

Conventional hydraulic impulse devices in practical use have been of the self-actuating type in which reciprocating motion of the piston which strikes the boring tool is caused by the switching of hydraulic pressure in a double acting cylinder by means of a spool valve actuated by changes in the position of the piston. Such devices have suffered from several drawbacks. First, since the period of the spool is determined by the period of the reciprocating motion of the piston, the striking frequency and the striking energy cannot be varied independently of each other. In other words, if the hydraulic pressure supplied to the piston is reduced in order to decrease the striking energy, the striking frequency is also reduced due to a reduction in the velocity of the piston. Accordingly, it is difficult to obtain efficient boring which can be adapted to geological variation. Particularly, in the case of rotary percussion drills, it is necessary to maintain an optimum combination of drill RPM, striking frequency, striking energy, feed, etc., and to change the RPM of the drill in accordance with variations in the striking frequency in order to achieve efficient boring. Complicated and expensive control devices are required in order to accomplish this end.

Furthermore, some reports state that when the piston strikes the boring tool, the efficiency of the energy transmission to the rod is improved if the period of time (hereinafter referred to as the push time) during which the piston pushes against the boring tool after initial contact is made is increased to some extent. In conventional devices, however, this push time is almost nonexistant.

Furthermore, since conventional devices are of the self-actuating type, a dead point exist. Therefore, the device may fail to start, depending upon the relative positions of the piston and the spool when the device is stopped. Accordingly, it is frequently necessary to attach a separate starter device in order to insure starting.

Furthermore, in such devices which are equipped with bladder type or diaphram type accumulators for the purpose of recovering energy from the return stroke of the piston and using it in the impulse stroke in order to increase efficiency, the striking frequency cannot be increased to any great extent due to problems in the accumulator response and durability.

In addition, conventional oscillator actuated hydraulic impulse devices use oscillation exciters which suffer from certain drawbacks when used in industrial equipment. Specifically, mechanical oscillation exciters which utilize an eccentric mass are excessively large in terms of structural size. Electrical oscillation exciters are easier to control and can achieve high oscillation frequency, but make it difficult to obtain a large power output. Devices which utilize a motor and air pressure generate excessive noise. Devices utilizing electro-hydraulic servo valves can achieve a large power output but are expensive and unsuitable for use in construction and mining machinery which is operated under harsh environmental conditions.

On the other hand, devices for generating oscillating pressure which utilize the self-excited oscillation of a hydraulic valve have been proposed. Oscillation exciters which utilize such devices as sources of pilot pressure have been able to compensate for previously mentioned drawbacks, but such devices are still unsatisfactory in some respects for use in percussion machinery such as hydraulic rock drills, hydraulic breakers, etc. Specifically, since the pressure variation of the oscillating pressure is small, this type of device cannot be used as a source of pilot pressure in machinery which is required to develop a large power output. Furthermore, if the device is designed such that the boring tool is struck at the point of maximum piston velocity in order to obtain a high striking energy, a considerable amount of time is required for the piston switching valve switch so that the piston begins its return stroke after striking the boring tool. This leads to an excessive increase in the amount of idle time during which the piston is in contact with the boring tool which in turn results in a decrease in efficiency rather than an increase.

Particularly, in cases where this type of device is used in a rotary percussion drill in which the bit is caused to revolve by means of a motor, etc., bit bradrasion becomes excessive. Furthermore, in order to achieve satisfactory efficiency, it is necessary to gradually store up energy during the return stroke of the piston by means of a spring (coil spring or accumulator, etc.) to release this energy in a rapid surge during the impulse stroke so that the piston is accelerated to a high velocity before it strikes the boring tool. For the above reasons, it is desirable that the time required for the impulse stroke of the piston be shorter than the time required for the return stroke. In conventional devices for generating oscillating pressure, however, the period of time during which a high pressure is maintained and the period of time during which a low pressure is maintained are approximately equal. Accordingly, the duration of impulse stroke and the duration of the return stroke are approximately equal.

SUMMARY OF THE INVENTION

Accordingly, it is a general object of the present invention to provide an oscillator actuated hydraulic impulse device which efficiently transmits energy from the piston to the boring tool for various geogological conditions.

It is another object of the present invention to provide a hydraulic impulse device for use in mountainous areas.

It is another object of the present invention to provide a hydraulic impulse device which utilizes the self-exciter oscillation of a hydraulic valve as a source of pilot pressure.

In keeping with the principles of the present invention, the objects are accomplished by an oscillator actuated hydrualic impulse device of the type which utilizes a spool valve actuated by an alternating signal from an oscillator to switch the hydraulic pressure in a double acting cylinder in order to create reciprocating motion of a piston which strikes the boring tool. The hydraulic impulse device further includes means for controlling the transition from the impulse stroke to the return stroke of the piston and a means for varying the duration of impulse stroke and the return stroke.

BRIEF DESCRIPTION OF THE DRAWINGS

The above mentioned and other features and objects of the present invention will become more apparent by reference to the following description taken in conjunction with the accompanying drawings and in which.

DETAILED DESCRIPTION OF THE INVENTION

Figure 1:
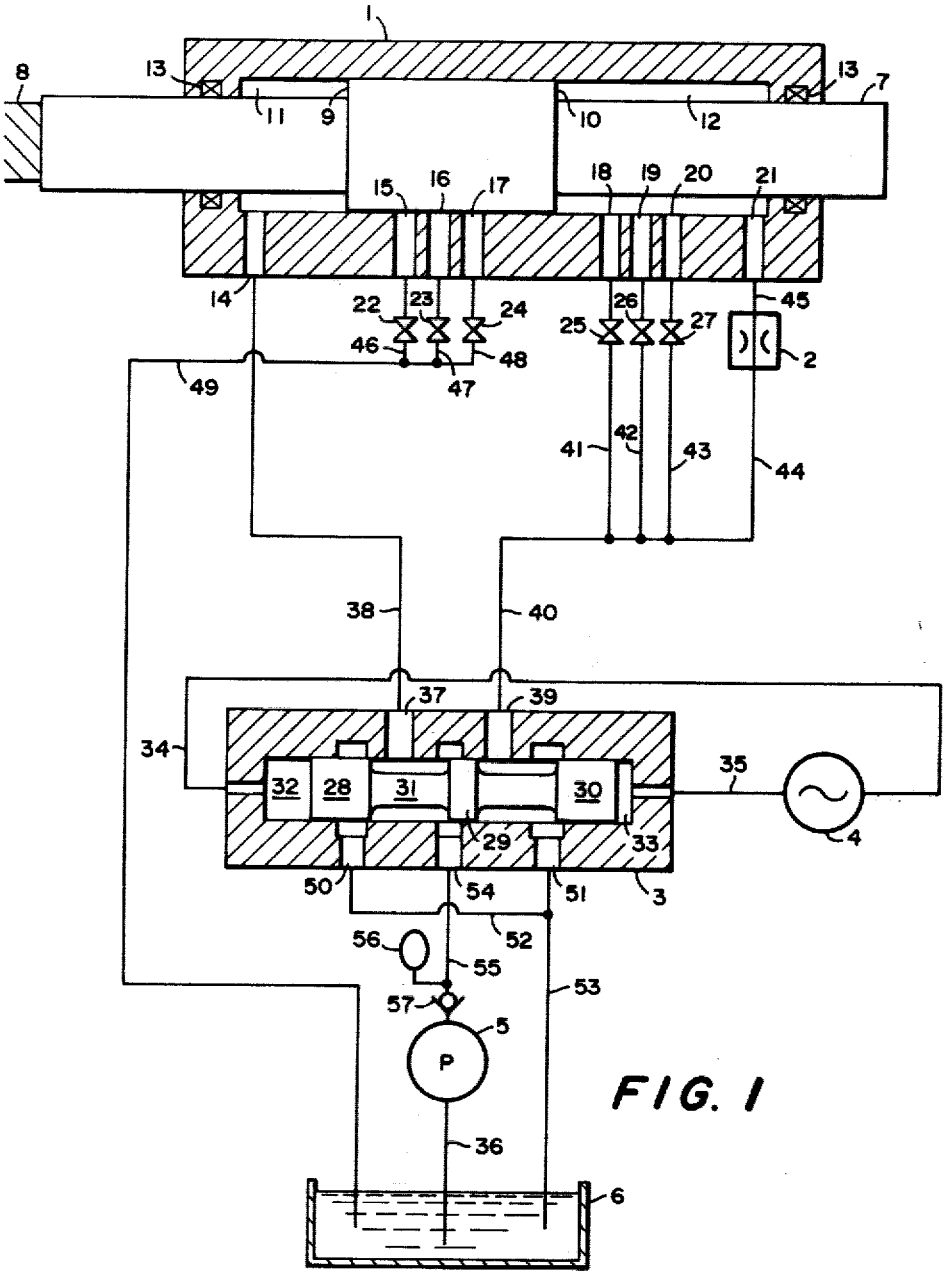
FIG. 1 is a cross section of a hydraulic impulse device in accordance with the teachings of the present invention illustrating a portion of the duct layout with the piston shown at the beginning of the return stroke.
Figure 2:
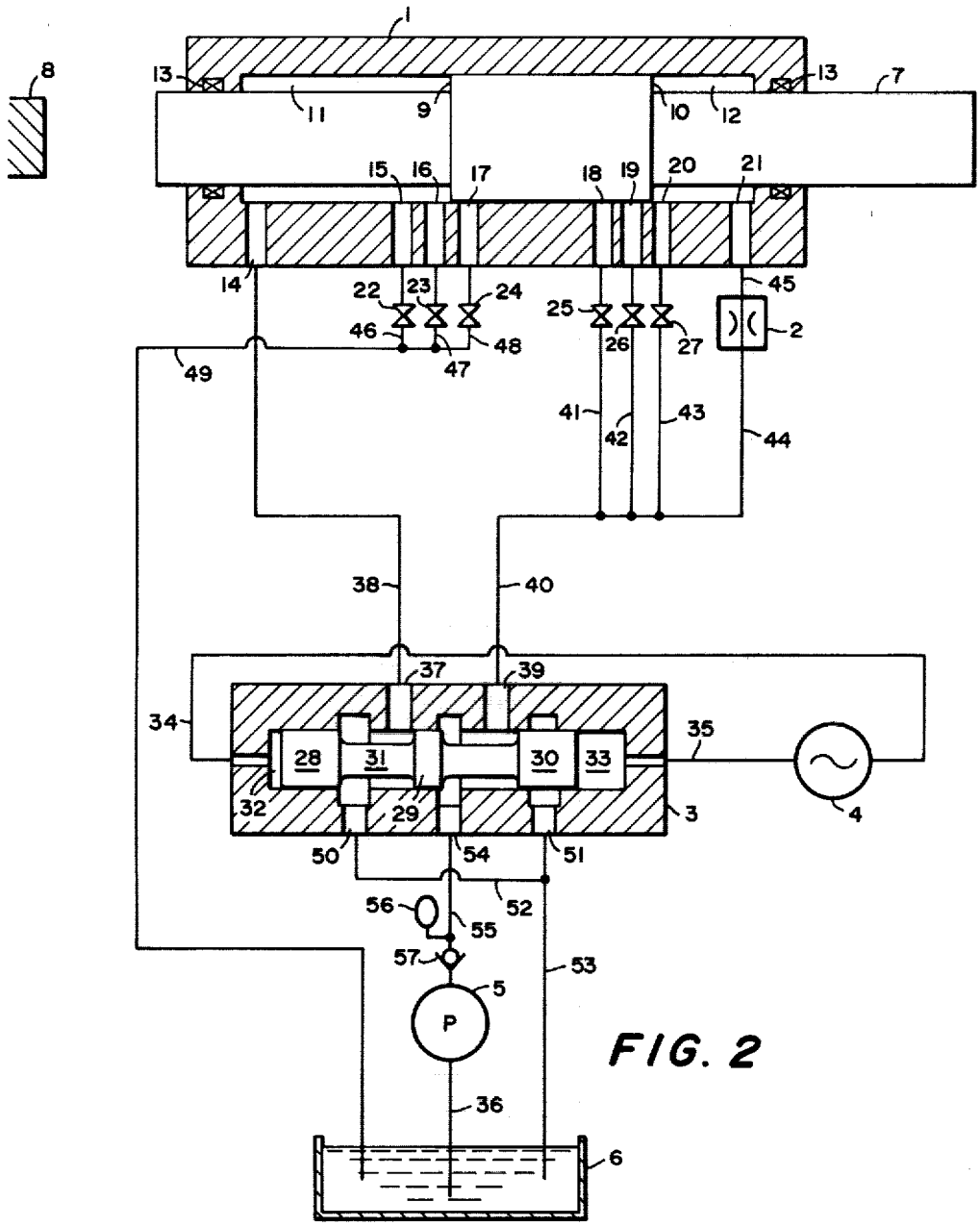
FIG. 2 is a cross section similar to that of FIG. 1 illustrating the operation of the embodiment of FIG. 1 with the piston shown at the beginning of the impulse stroke.

Referring more particularly to the FIGURES, shown in FIGS. 1 and 2 is a hydraulic impulse device in accordance with the teachings of the present invention. The hydraulic impulse device includes a double acting cylinder 1, a throttle valve 2, a spool valve 3, and oscillator 4, a pump 5, a tank 6 and lines and valves which interconnect these components.

A piston 7 which strikes a boring tool is provided in double acting cylinder 1 such that it slides back and forth. One end of piston 7 strikes a boring tool 8 such as a shank rod, etc. The piston 7 has two step parts 9 and 10 which together with the cylinder walls form respectively forward cylinder chamber 11 and the rear cylinder 12. The air tight integrity of the cylinder 1 is maintained by means of air tight piston bearings 13. Furthermore, fluid inlet and outlet ports 14 through 21 are provided in cylinder 1. Of these, port 14 is located at the end of the cylinder 1 which is adjacent to the boring tool 8, port 21 is located at the opposite end of cylinder 1 from the boring tool 8, ports 15, 16 and 17 are located at appropriate positions near the mid-point of the forward cylinder chamber 11 and ports 18, 19 and 20 are located in appropriate positions near the rear cylinder chamber 12. Valves 22 through 27 are respectively connected to the aforementioned ports 15 through 20 such that selective ports can be opened and closed as desired.

Spool valve 3 is of the two position four port type. A spool 31, which has three cylindrical lands 28, 29 and 30 is provided within spool valve 3 such that it can slide back and forth. Oscillator 4 is provided for the purpose of causing reciprocating motion of spool 31. The oscillator 4 is coupled with the pilot chambers 32 and 33 of the spool valve 3 by means of lines 34 and 35. The oscillator 4 may be of any type, e.g. electrical, hydraulic, mechanical, etc., so long as it is able to cause reciprocating motion of the spool 31.

The main flow line which couples the component devices is arranged such that fluid is drawn up from the tank 6 by the pump 5 and alternately delivered under high pressure to the forward cylinder, chamber 11 and the rear cylinder chamber 12 via the spool valve 3.

Specifically, tank 6 is connected to pump 5 by line 36, port 37 of spool valve 3 is coupled with port 14 of cylinder 1 by line 38 and 39 of spool valve 3 is coupled with ports 18, 19 and 20 via line 40 and lines 41, 42 and 42 branch off from line 40 via valves 25, 26 and 27. Furthermore, a branch line 44 is fed off from line 40 to form a flow line which is coupled to port 21 of cylinder 1 via throttle valve 2 and line 5. Also, ports 15, 16 and 17 of cylinder 1 are coupled to tank 6 via valves 22, 23 and 24, lines 46, 47 and 48 and line 49. Furthermore, ports 50 and 51 of spool valve 3 are coupled with tank 6 via lines 52 and 53. Pump 5 is coupled to port 54 of spool valve 3 via line 55. An accumulator 56 and a check valve 57 are provided at an intermediate point on line 55 in order to achieve efficient energy utilization. However, accumulator 56 and check valve 57 could be omitted if so desired.

For the sake of the following description of the operation of the present invention, assume that valves 22, 25 and 27 are closed and valves 23 and 26 are left open and that the piston 7 has the struck the boring tool 8 and is about to begin its return stroke.

In operation, when the signal pressure from the oscillator 4 reaches the pilot chamber 32 of the spool valve 3, the spool 31 begins to move to the right and high pressure fluid is supplied to the forward cylinder chamber 11 via port 54 and 37, line 38, and port 14. At this time, the rear cylinder chamber 12 is unloaded via port 19, lines 42 and 40, ports 39 and 51 and line 53. Accordingly, the fluid inside the rear cylinder chamber 12 is discharged into tank 6 and the piston 7 is caused to return to the right.

When the piston 7 has been pushed back to a certain extent, its step part 9 reaches port 16, whereupon the high pressure fluid inside the forward cylinder chamber 11 is discharged into the tank 6 from port 16. Accordingly, the force accelerating the piston 7 is removed and the piston continues to move by virtue of inertia alone. When the piston 7 has moved even further back, its step part 10 reaches port 19 whereupon all of the fluid in the rear cylinder chamber 12 begins to be discharged into the tank 6 exclusively via port 21, throttle valve 2 and lines 44 and 40. At this time, the flow of the discharged fluid is constricted by the throttle valve 2 which exerts a breaking effect upon the piston 7. By using a variable throttle valve it is possible to change the throttle constriction to suit the piston velocity.

When the signal from the oscillator 4 changes such that the signal pressure reaches the pilot chamber 33 of the spool valve 3 via line 35, the spool 31 moves to the left with regard to the figure and high pressure fluid from pump 5 is delivered to the rear cylinder chamber 12 under conditions which are just the reverse of those shown in FIG. 1. Hydraulic pressure supplied to the rear cylinder chamber 12 is initially supplied only from the port 21. However, when the piston 7 has advanced far enough for the step part 10 to open port 19, the pressure will be supplied mainly from port 19. Meanwhile, a portion of the fluid inside the forward cylinder chamber 11 is discharged directly into the tank 6 from port 16 during the period immediately following the time in which the piston 7 begins to advance. However, after the step part 9 has closed port 16, all of the fluid is discharged via the spool valve 3.

By repeating the strokes described above, the piston 7 delivers successive blows to the boring tool 8.

The pressure vent ports 16 and 17 which open into the forward cylinder chamber 11 and the ports 18, 19 and 20 (for regulating the time at which the piston braking begins) which open into the rear cylinder 12, can each be selectively open or closed by means of a valve in order to regulate the end of the return stroke of the piston 7. According, braking at the end of each stroke can easily be adjusted to suit the boring conditions, such as, elasticity, etc. of the rock.

The hydraulic impulse device in accordance with the teachings of the present invention can be used not only as a breaker, but also as a rotary percussion drill by adding a common rotary device such as a hydraulic motor, etc. to drive the boring tool. In such a case, the striking frequency can be independently maintained at a uniform level even if the striking energy is reduced in accordance with the reduction in the resistance of the rock during crushing. Accordingly, it is necessary (as it is in the case of conventional self-actuating hydraulic impulse devices) to reduce the drill RPM by means of a complicated costly control system employing a variable pump, etc. Therefore, the device as a whole is simple and inexpensive.

Figure 3:
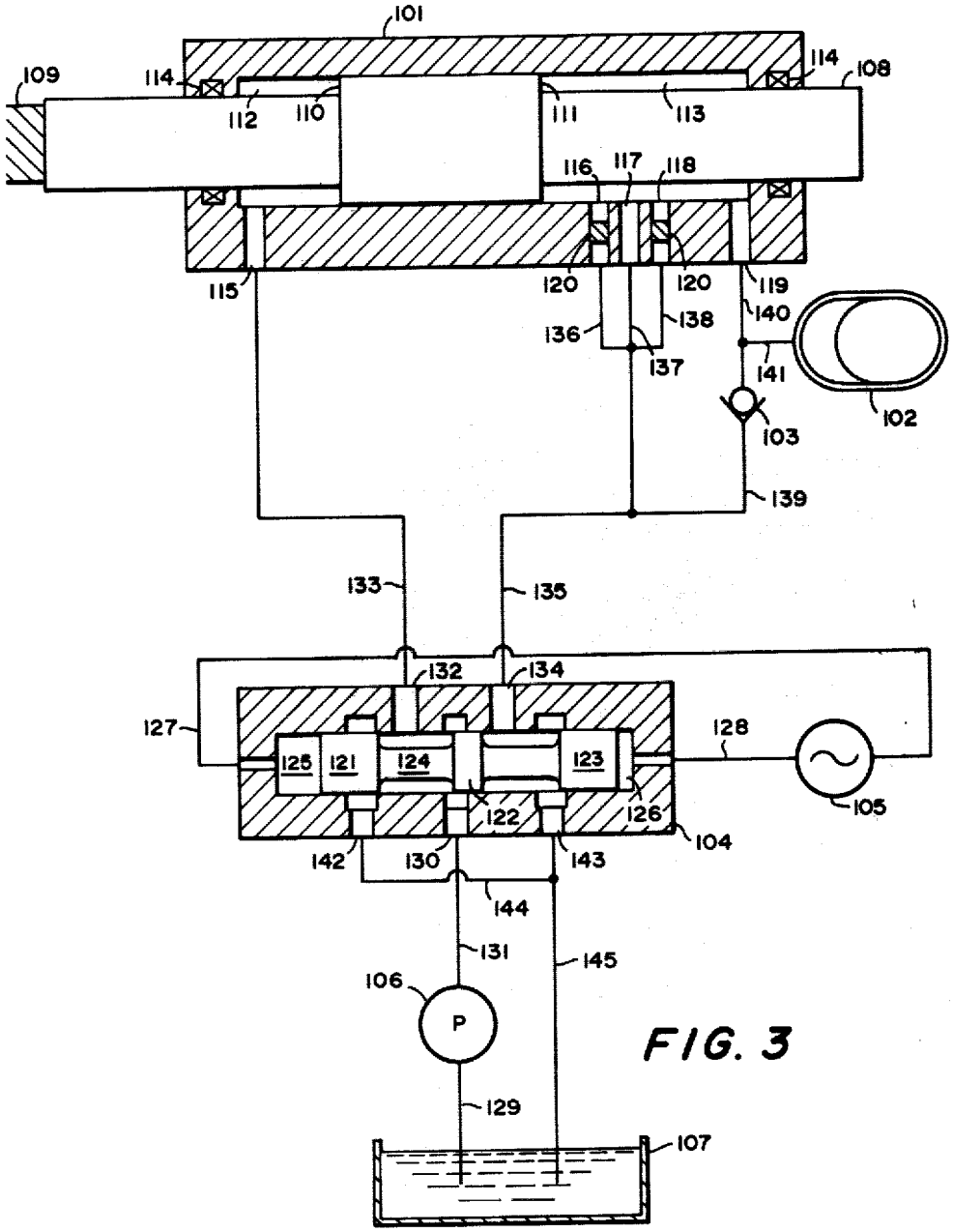
FIG. 3 is a cross section similar to FIG. 1 illustrating a second embodiment of a hydraulic impulse device in accordance with the teachings of the present invention in which the piston is shown as the beginning of the return stroke.
Figure 4:
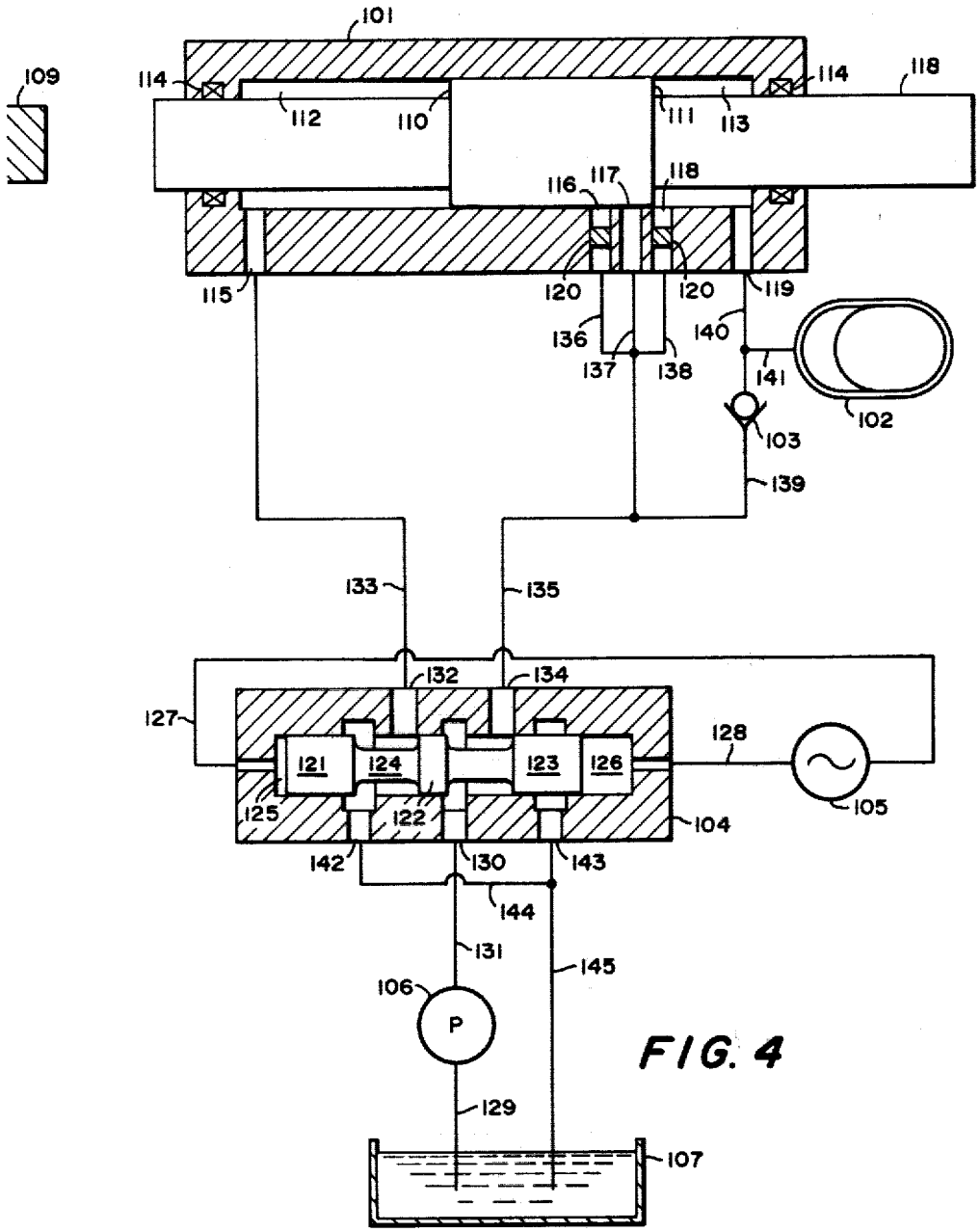
FIG. 4 is a cross section similar to FIG. 1 illustrating the operation of the embodiment of FIG. 3 with the piston shown at the beginning of the impulse stroke.

Referring to FIGS. 3 and 4, shown therein is a second embodiment of a hydraulic impulse device in accordance with the teachings of the present invention. Hydraulic impulse device of FIGS. 3 and 4 consist of a double acting cylinder 101, an accumulator 102, a check valve 103, a spool valve, oscillator 105, a pump 106, a tank 107 and lines which interconnect these components.

A piston 108 which strikes a boring tool 109 is provided within double acting cylinder 101 such that it can slide back and forth. One end of piston 108 strikes a boring tool 109 such as a shank rod, etc. The piston 108 has two step parts 110 and 111 which together with the cylinder walls respectively forms pressure chambers 112 (hereinafter referred to as forward cylinder chamber 122) located in the end of the cylinder 101 which is adjacent to the boring tool 109 and a rear chamber 113. The air tight integrity of the cylinder 101 is maintained by means of an air tight piston bearing 114. Furthermore, fluid inlet and outlet ports 115 through 119 are provided in cylinder 101. Of these, ports 115 is located in the end of the cylinder 101 which is adjacent to the boring tool 109, port 119 is provided in the opposite end of the cylinder 101 from the boring tool 109 and the ports 116, 117 and 118 are provided in appropriate positions near the mid-point of the rear cylinder chamber 113. Plugs 120 are provided in the ports 116, 117 and 118 such that selective ports can be opened and closed as desired. In FIG. 1, only port 17 is open.

The spool valve 104 of the two position four port type. A spool 124, which has three cylindrical lands 121, 122 and 123 is provided within valve 104 such that it can slide back and forth. Oscillator 105 is provided for the purpose of causing reciprocating motion of spool 124. The oscillator 105 is coupled with the pilot fluid pressure chambers 125 and 126 of the spool valve 104 by lines 127 and 128. The oscillator may be of any type, e.g. electrical, hydraulic, mechanical, etc., so long as it is able to cause reciprocating motion of the spool 124.

The main flow line which couples the component devices is arranged so that the fluid is drawn up from the tank 107 by the pump 106 and alternately delivered under high pressure to the forward cylinder 112 and the rear cylinder chamber 113 via spool valve 104.

Specifically, tank 107 is coupled with pump 106 via line 129, pump 106 is coupled with port 130 of spool valve 104 via line 131, port 132 of spool valve 104 is coupled to port 115 of cylinder 101 via line 133 and port 134 of spool valve 104 is coupled to ports 110, 117 and 118 of the cylinder 101 via lines 135 and lines 136, 137 and 138 branching from lines 135. Furthermore, a branch line 139 is lead off from 135 to form a flow line which reaches port 119 of cylinder 101 via check valve 103 and line 140. This line 140 is coupled to the accumulator 102 by a line 141. The check valve 103 is provided as that high pressure fluid does not flow from the rear cylinder chamber 113 to the spool valve 104. Furthermore, ports 142 and 143 of the spool valve 104 are unloaded via lines 144 and 145.

In operation, in FIG. 3, the piston 108 has struck the boring tool 109 and is about to begin its return stroke. When the signal pressure from the oscillator 105 reaches the pilot pressure chamber 125 of the spool valve 104, the spool 124 begins to move to the right and high pressure fluid is supplied to the forward cylinder chamber 112 via ports 30 and 32, line 33 and port 15. At this time, the rear cylinder chamber 113 is unloaded via port 117, lines 137 and 139 and ports 134 and 143. Accordingly, the fluid inside the rear cylinder chamber 113 is discharged into tank 7 and the piston 108 is caused to return to the right.

When the piston 108 has been pushed back to a certain extent, its step part 111 closes port 117. The fluid discharged from rear cylinder chamber 113 tries to flow out through port 119 and line 140 but is stopped by check valve 103 so that it flows into accumulator 102. Accordingly, the piston is braked by the spring action of the accumulator 102 so that the shock occurring at the end of the piston stroke is absorbed. In this embodiment, the effect of the accumulator 102 action can easily be altered to suit boring conditions by closing port 117 and opening port 116 or port 118. This is done by changing the position of the plugs 120.

When the signal from oscillator 105 changes so that the pilot pressure reaches the pilot pressure chamber 126 via line 128, the spool 124 moves to the left with regard to the figures and high pressure fluid from the pump 106 is delivered to the rear cylinder chamber 113 under conditions which are just the reverse of those shown in FIG. 3. Since the forward cylinder chamber 112 is unloaded at this time, the piston 108 begins its impulse stroke. At the instant of transition to the impulse stroke following the switching of the spool valve 104, the pressure inside the accumulator 102 is greater than the pressure delivered by the pump 106. Accordingly, fluid which has accumulated inside the accumulator 102 has discharged into the rear cylinder chamber 113 in a rapid surge and the piston 108 is abruptly accelerated. This discharge continues until the piston 108 has advanced far enough to equalize the pressure inside the accumulator 102 with that delivered by the pump 106. Afterwards, the piston is accelerated by the force which depends entirely upon the pressure delivered by the pump 106 and finally strikes the boring tool 109.

By repeating the above mentioned strokes, the piston 108 delivers successive blows to the boring tool 109.

Figure 5:
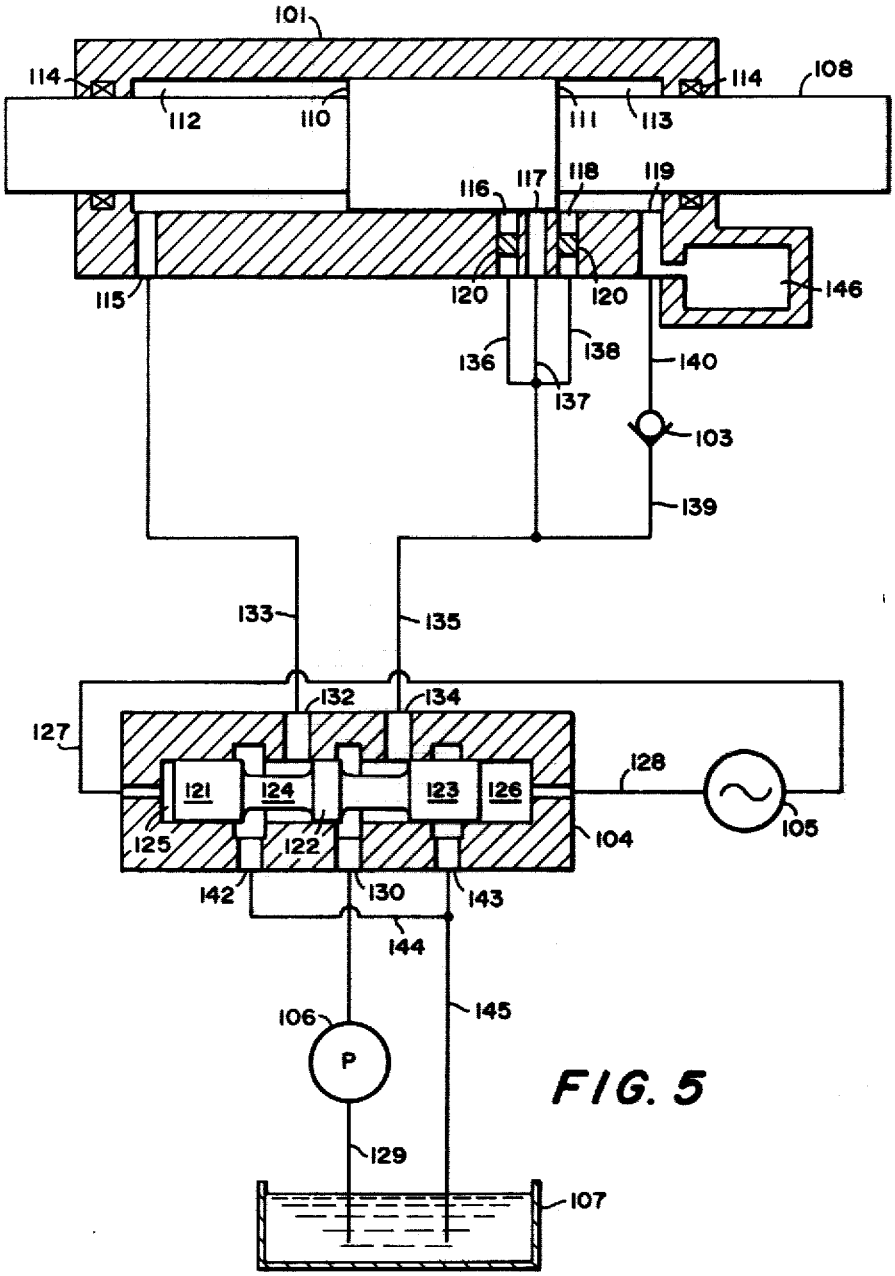
FIG. 5 is a cross section similar to FIG. 1 illustrating the partial duct layout of a third embodiment of a hydraulic impulse device in accordance with the teachings of the present invention.

The principle purpose of the accumulator 102 in this embodiment is to regulate the end of the return stroke of the piston and to absorb the resulting shock. The reciprocating motion of the piston 108 is achieved entirely by means of the alternating hydraulic pressure delivered by the spool valve 104. Accordingly, it is possible to achieve striking frequency which are higher than those obtained in conventional models. However, in the case of common bladder type or diphram type accumulators, a great increase in striking frequency creates problems in response and durability. On the other hand, if a fluid chamber 146 is provided in the body of the impulse device itself (as shown in FIG. 5) and caused to act as an accumulator by utilizing the compressability of the fluid, higher striking frequencys can be achieved by increasing the delivered pressures and there will be no problem as to durability.

Figure 6:
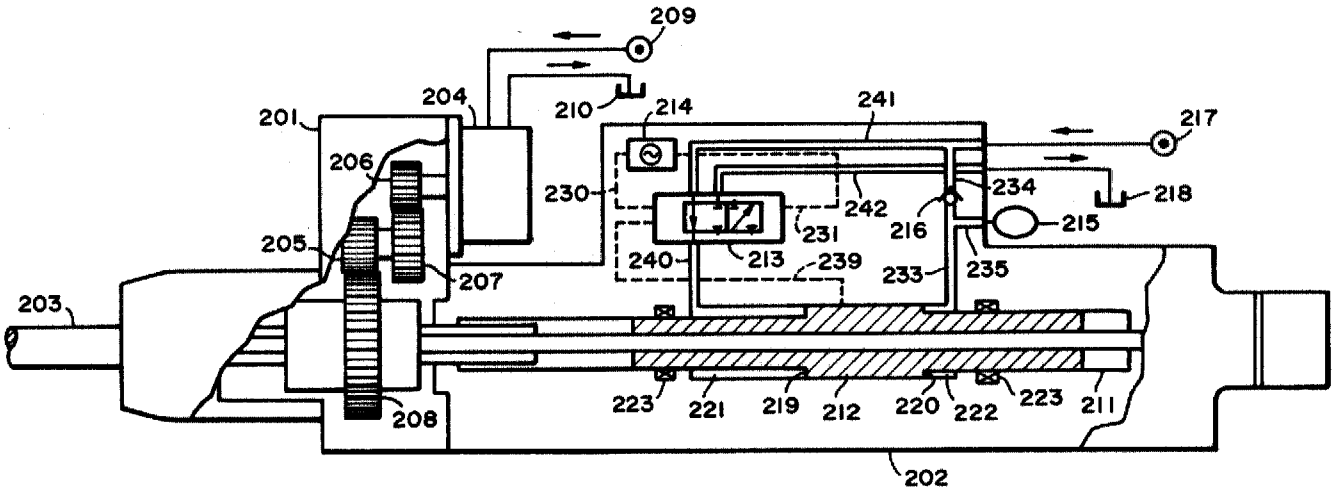
FIG. 6 is a cross section of a rotary percussion drill which utilizes a fourth embodiment of a hydraulic impulse device in accordance with the teachings of the present invention.
Figure 7:
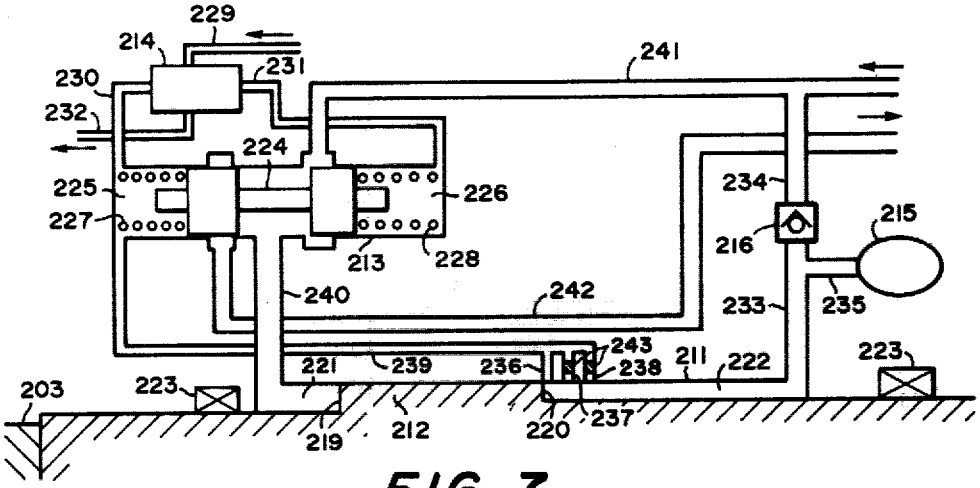
FIG. 7 is a magnified cross section of the embodiment of FIG. 6 during the return stroke of the piston.

Referring to FIGS. 6 through 9, shown therein is a rotary percussion drill utilizing a hydraulic impulse device in accordance with the teachings of the present invention. The rotary percussion drill consists of a drill rotating mechanism 201, a drill impulse mechanism 202 and a drill 203. The drill rotating mechanism 201 includes a hydraulic motor 204, gears 205 through 207, revolving sleeve 208 with an attached gear, a hydraulic pressure source 209 and a tank 210. The drill 203 is provided in the revolving sleeve 208 such that it can simultaneously revolve and reciprocate. FIG. 7 is a magnified portion of FIG. 6 illustrating the drill impulse mechanism 202. The drill impulse mechanism 202 includes a differential cylinder 211, a piston 212 which strikes the drill 203, a spool valve 213, an oscillator 214, and an accumulator 215, a check valve 216, a hydraulic pressure source 217, a tank 218 and lines which interconnect these components.

Piston 212 is provided within cylinder 211 such that it slides back and forth. The piston 212 has two step parts 219 and 220 which together with the cylinder walls form respectively the forward cylinder chamber 221 and the rear cylinder chamber 222. The diameter of the shaft of the piston 212 is smaller on the side of the forward cylinder chamber 221 than on the side with the rear cylinder chamber 222 such that the piston area is great on the side of the forward cylinder chamber 221. Furthermore, the air tight integrity of cylinder 211 is maintained by means of an air tight piston bearing 223.

The spool valve 213 is of the two piston three port type. A spool 224 is provided within spool valve 213 such that it can slide back and forth. The spool 224 is maintained in a neutral position by springs 227 and 228 which are respectively installed in pilot pressure chambers 225 and 228 provided at both ends of the spool 213.

Oscillator 214 receives appropriate fluid via line 229 and delivers an alternating hydraulic pressure to pilot pressure chambers 225 and 226 of spool valve 213 via lines 230 and 231. Furthermore, oscillator 214 is designed such that the fluid expelled by the reciprocating motion of the spool 224 is returned to the oscillator 214 via lines 231 and 230 and unloaded via line 232 along with the fluid expended by the oscillation of the oscillator 214.

Furthermore, the oscillator 214 may be of any type, e.g. electrical or mechanical, hydraulic, etc., so long as it is able to cause reciprocating motion of the spool 224.

Rear cylinder chamber 222 is coupled to hydraulic pressure source 217 via line 233, check valve 216 and line 234. Furthermore, accumulator 215 is coupled to line 233 at a point between check valve 216 and rear cylinder chamber 222 via line 235. Furthermore, ports 236, 237 and 238, which are for the purpose of obtaining a pilot pressure used to detect the change in position of the piston 212, are provided in the rear cylinder chamber 222 at points towards the mid-point of the cylinder 211. These ports are coupled to pilot pressure chamber 225 of spool valve 213 via line 239.

In addition, forward cylinder chamber 221 is coupled to spool valve 213 via line 220 and to hydraulic pressure source 217 via the spool valve 213 and line 241 and is unloaded via spool valve 213 and line 242.

For the purposes of the following description, it is assumed that the piston 212 in FIG. 7 has contacted drill 203 and is about to begin its return stroke. At this time a signal from oscillator 214 reaches chamber 225 to start the switching of spool valve 213. However, since a high pressure is present in rear chamber 222 and therefore in port 236, pilot pressure from port 236 takes priority over the signal from oscillator 214 and as a result pilot pressure reaches the pilot pressure chamber 225 of the spool valve 213 via port 236 and line 239 and the spool valve 213 is switched to the position shown in FIG. 7 without any further signal from the oscillator 214. In other words, the pilot pressure from the oscillator 214 acts in the chamber 225 when the piston 212 is switched over to the return stroke, and the pilot pressure from the port 236 takes priority over the pilot pressure from the oscillator 214 applied through the line 230 since the pilot pressure fed from the port 236 is higher than a pilot pressure from the oscillator 214. Accordingly, a Pressure is delivered to both the forward cylinder chamber 221 and the rear cylinder chamber 222 and the piston 212 begins its return stroke as a result of the difference in the piston areas of the two chambers. At this time, the fluid expelled from the rear cylinder chamber 222 by the piston 212 is stopped by the check valve 216 and is caused to accumulate in accumulator 215. In addition, the oil which has been pushed out by the rearward movement of the spool 224, passes through the line 231, enters the valve chamber (the valve chamber 527 shown in FIG. 20) of the oscillator 214, passes through the throttle restriction and then, is discharged into the tank.

Figure 8:
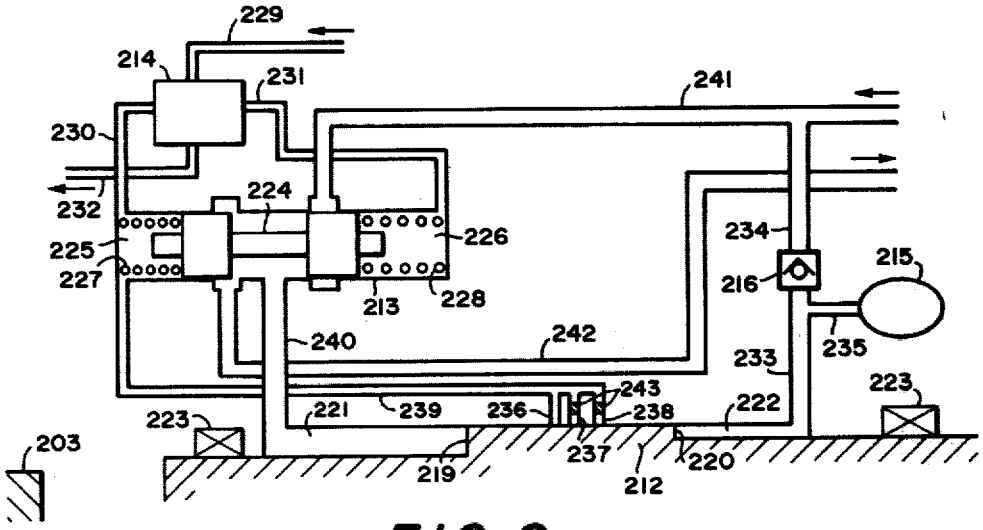
FIG. 8 is a magnified cross section similar to that of FIG. 7 illustrating the operation of the embodiment of FIG. 6 during the impulse stroke of the piston.

When the signal from the oscillator 214 is received at chamber 226 at the end of return stroke of the piston 212, the spool valve 213 assumes the attitude shown in FIG. 8, thereby causing the forward cylinder chamber 221 to be unloaded such that a force of $P_b \times A_F$ acts on piston surface on the side of the forward cylinder chamber 221 (where $P_b$ is the back pressure in the forward cylinder chamber 221). At this time, a force $P \times A_R$ is applied to the piston surface on the side of the rear cylinder chamber 222. Since $P_b$ is much less than P, it follows that $P_b$ times $A_F$ is less than P times $A_R$. Accordingly, the piston 212 begins its impulse stroke. The potential energy which was stored in the accumulator 215 during the return stroke is converted into kinetic energy of the piston 212 during the impulse stroke.

By repeating the above described strokes, the piston 212 delivers successive blows to the drill 203. Meanwhile, revolution of the drill 203 is caused by the hydraulic motor independently of the reciprocating motion of the piston 212.

In this embodiment, since the striking frequency is determined by the oscillation frequency of the oscillator 214, it can be varied by varying the pressure delivered to the oscillator 214. The construction of oscillators such as oscillator 214 whose frequency varies in accordance with the delivered pressure is well known in the prior art. On the other hand, the striking energy can be varied by varying the pressure delivered to the piston 212 by the hydraulic pressure source or the pressure of the gas enclosed in the accumulator 215. Furthermore, the drill RPM can be varied by adjusting the amount of supply flow to the hydraulic motor. In addition, push time can be varied by adjusting the actuation timing of the signal from port 236. Accordingly, the striking frequency, striking energy, drill RPM and push time can be varied independent of each other and it is therefor possible to achieve boring which can be adapted to the hardness of the rock without using any of the complicated devices such as variable pumps, etc., required by conventional models.

Furthermore, in this embodiment the ratio of the piston area $A_F$ on the side of the forward cylinder chamber 221 to the piston area $A_R$ on the side of the rear chamber 222 is established such that $A_F$ divided by $A_R$ is greater than 1 but less than 2. This is done in order to insure that successive delivery of satisfactory blows to the drill and for the following reasons. In the hydraulic impulse device provided by this invention, the spool valve 213 receives an alternating signal from the oscillator 214 which is completely independent of the position of the piston 212 and also receives a signal from the rear cylinder chamber 222 when the piston 212 has completed its impulse stroke. The return stroke is actuated by the signal from the rear cylinder chamber 222 while the change over to the impulse stroke is accomplished by means of the signal from the oscillator 214. However, there is a phase difference between the signal from the oscillator 214 and the signal created by the change in the position of piston 212 and the magnitude of this difference is uncertain.

Accordingly, if the piston 212 return signal from the oscillator 214 (for example) lags far behind the signal created by the change in the position piston 212, the signal which switches the piston 212 over to the impulse stroke also lags far behind, thereby causing the piston to be pushed back too far. As a result, the return piston signal from the oscillator 214 will be received in the middle of the impulse stroke before the piston 212 reaches the drill 203 and the piston 212 will be caused to return. The result is an undesirable state which the piston 212 reciprocates but does not strike the drill 203.

In order to overcome this problem, it is advisable to increase the velocity of the piston 212 during the return stroke such that the signal created by the change in position for the piston 212 will be received before the piston return signal from the oscillator 214 is received. In order to accomplish this, it is necessary that the amount of time required for the return stroke of the piston 212 be greater than the amount of time required for the impulse stroke of the piston 212. In order to satisfy this condition, it is only necessary to insure that the force which acts on piston 212 during impulse stroke is greater than the force in operation during the return stroke. The following relationship satisfies this condition: $PA_R$ minus $P_B A_F$ is greater than $PA_F$ minus $PA_R$. Where $P_B$ is the back pressure present in forward cylinder chamber 221. Assuming for the sake of simplicity that $P_B$ equals zero, it follows that $A_F$ divided by $A_R$ is less than 2. However, since $A_F$ is greater than $A_R$, the following condition is obtained: $A_F$ divided by $A_R$ is greater than 1 but less than 2.

Figure 9:
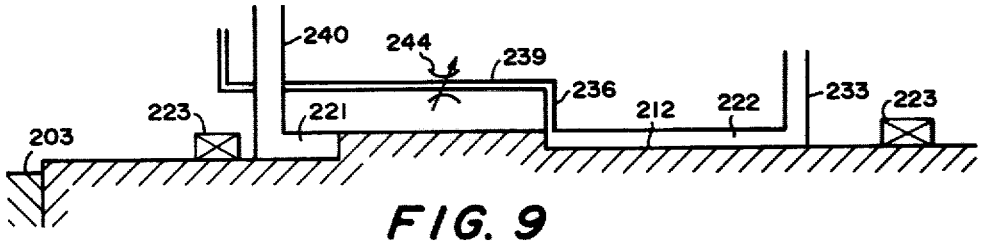
FIG. 9 is a magnified cross section of an impulse mechanism of a fifth embodiment of a hydraulic impulse device in accordance with the teachings of the present invention.

Furthermore, in this embodiment a multiple number of ports are installed along the line of piston 212 advance in order to obtain the pilot pressure which actuates the spool valve 213 from the rear cylinder chamber 222. Since these ports can be selectively opened or closed by means of plug 243, the timing of the actuation of the spool valve 213 by the pilot pressure and therefore the push time can easily be varied. Furthermore, it would also be possible to vary the actuation timing of the pilot pressure and thereby the push time by installing a variable throttle valve 244 at an intermediate point along the line and varying the amount of restriction (as shown in FIG. 9) instead of installing a multiple number of ports.

Figure 10:
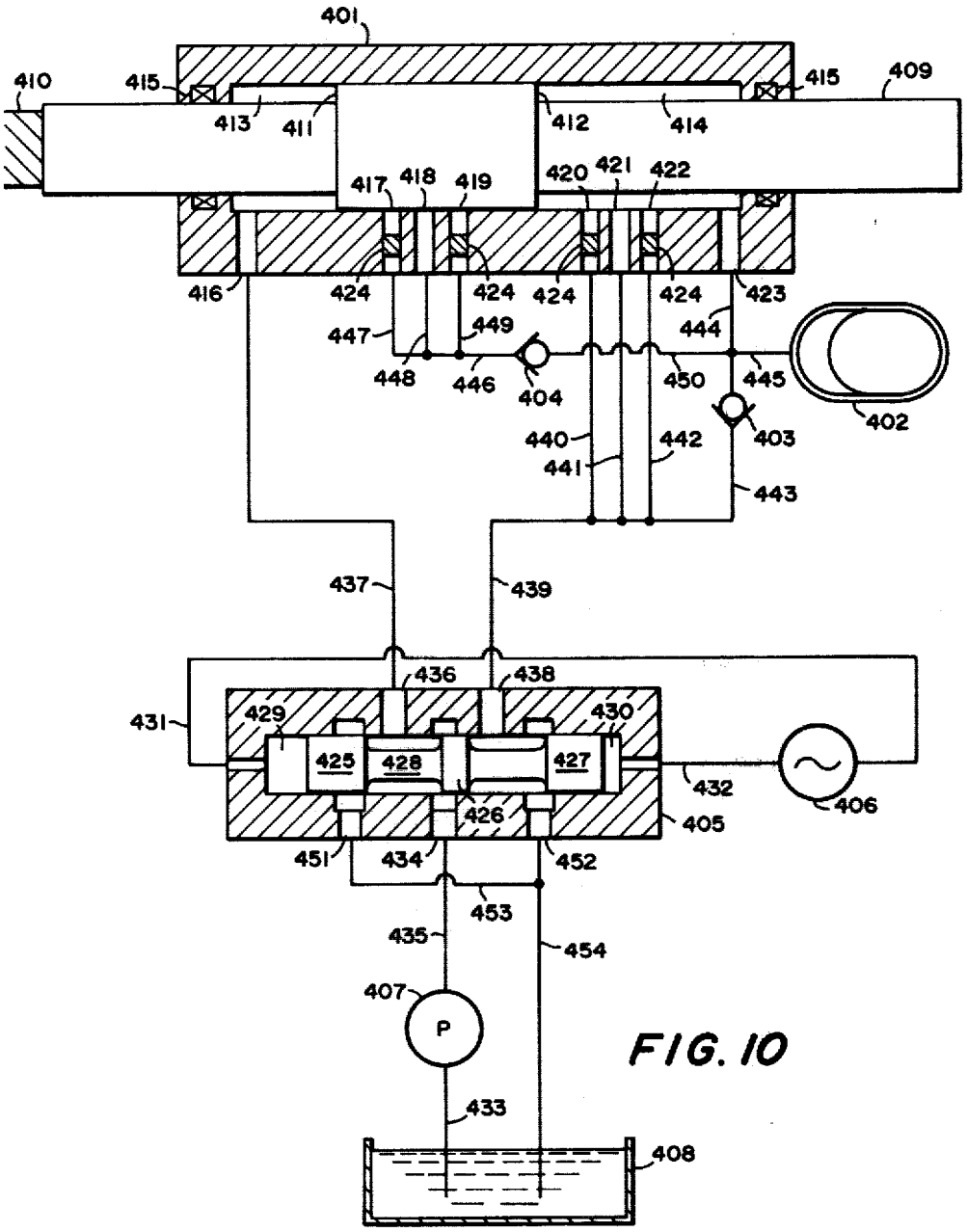
FIG. 10 is a cross section view similar to FIG. 1 illustrating a partial duct layout of a sixth embodiment of a hydraulic impulse device in accordance with the teachings of the present invention with the piston shown at the beginning of the return stroke.
Figure 11:
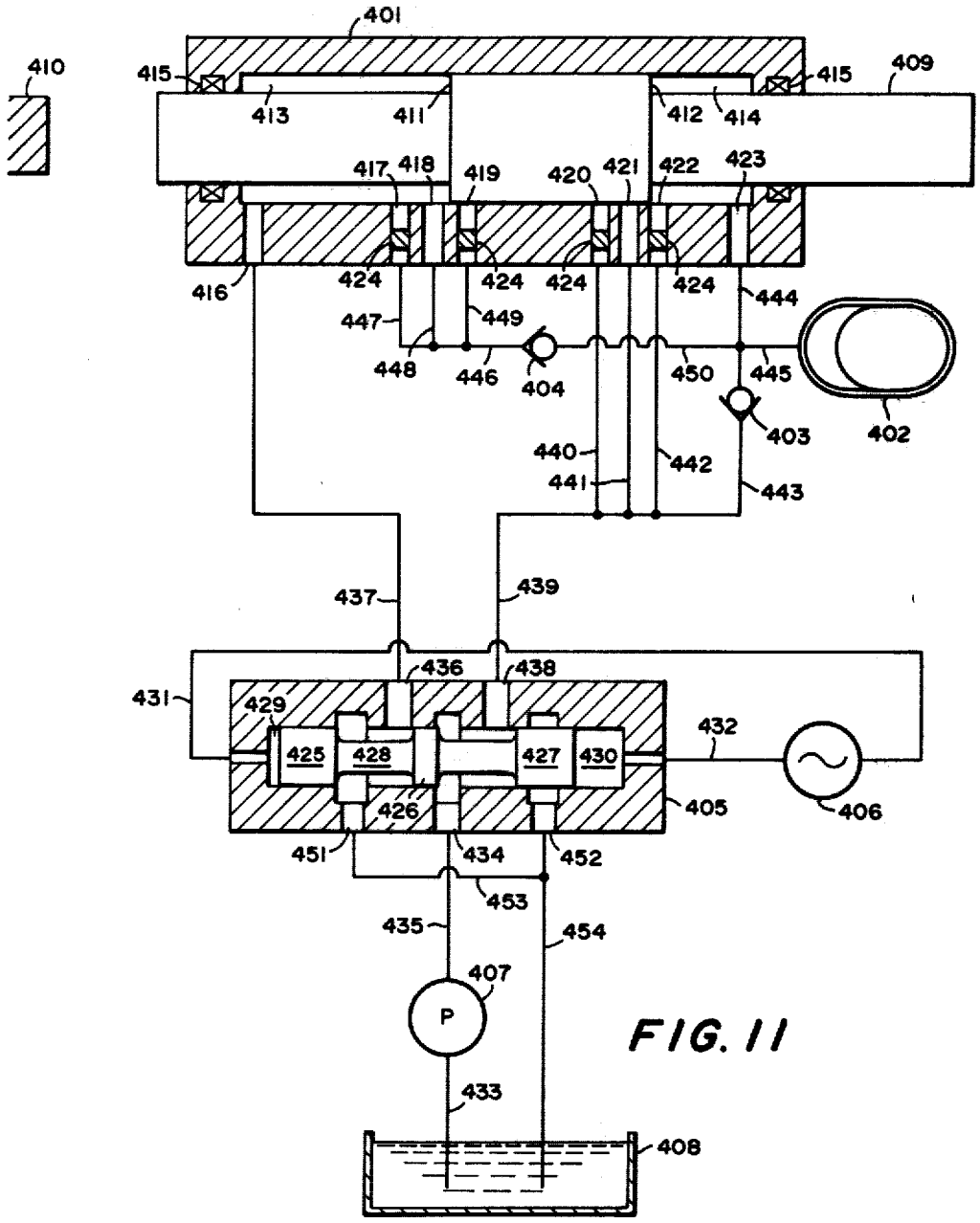
FIG. 11 is a cross sectional view similar to that of FIG. 10 illustrating the operation of the embodiment of FIG. 10 with the piston shown at the beginning of the impulse stroke.
Figure 12:
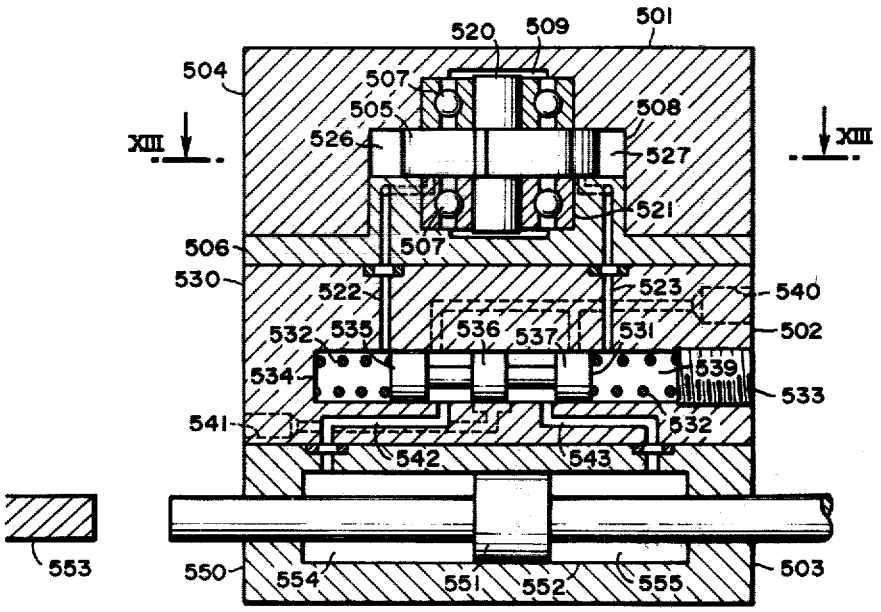
FIG. 12 is a vertical cross section of a hydraulic breaker utilizing a seventh embodiment of a hydraulic impulse device in accordance with the teachings of the present invention illustrating a hydraulic oscillator.

Referring to FIGS. 10 and 11, shown therein is a cross section of a sixth embodiment of a hydraulic impulse device in accordance with the teachings of the present invention. The hydraulic impulse device in FIGS. 10 and 11 includes a double acting cylinder 401, an accumulator 402, check valves 403 and 404, a spool valve 405, an oscillator 406, a pump 407, a tank 408 and lines which interconnect these components.

Piston 409, which strikes the boring tool 410, is provided within double acting cylinder 401 such that it can slide back and forth. Piston 409 has two step parts 411 and 412 which together with the cylinder walls, form respectively the forward cylinder 413 and the rear cylinder chamber 414. The air tight integrity of the cylinder 401 is maintained by means of an air tight piston bearings 415. Furthermore, the fluid inlet and outlet ports 415 through 423 are provided in the cylinder 401. Of these, port 416 is provided in the end of cylinder 401 which is adjacent to the boring tool 410, port 423 is located in the opposite end of the cylinder 401 from the boring tool 410. Ports 417, 418 and 419 are located in appropriate positions near the mid-point of the forward cylinder chamber 413 and ports 420, 421 and 422 are located in appropriate positions near the point of the rear cylinder chamber 414. Plugs 424 are provided in the ports 417 through 422 such that selected ports can be opened or closed as desired. In FIG. 10, ports 418 and 421 are open.

The spool valve 401 is of the two position four port type. A spool 428 which has three cylindrical lands 425, 426 and 427 is provided within the spool valve 405 such that it can slide back and forth. The oscillator 406 is provided for the purpose of causing reciprocating motion of the spool 428. The oscillator 406 is coupled with the pilot pressure chambers 429 and 430 of the spool valve 405 via lines 431 and 432. The oscillator 406 may be of any type so long as it is able to cause reciprocating motion in the spool 428.

The main flow line which connects the above described component parts is arranged such that the fluid is drawn up from the tank 408 by the pump 407 and alternately delivered under high pressure to the forward cylinder chamber 413 and the rear cylinder chamber 414. Specifically, the tank 408 is connected to the pump 407 by line 433, the pump 407 is coupled to port 434 of spool valve 405 via line 435, port 436 of spool valve 405 is coupled to port 416 of cylinder 401 via line 437 and port 438 of spool valve 405 is coupled to ports 420, 421 and 422 of cylinder 401 by line 439 and lines 440, 441 and 442 branching off of line 439. Furthermore, branch line 444 is lead off from line 439 to form a flow line which is coupled to port 423 of cylinder 401 via a check valve 403 and line 444. The check valve 403 is provided such that high pressure fluid does not flow from the rear cylinder chamber 414 to the spool valve 405. The line 444 is coupled to an accumulator 402 via line 445. Furthermore, line 444 is also coupled to ports 417, 418 and 419 of cylinder 401 by lines 446, 447, 448 449 and 450 via a check valve 404. The check valve 404 is provided such that high pressure fluid does not flow from line 450 to ports 417, 418 and 419. Furthermore, ports 451 and 452 of spool valve 405 are unloaded via lines 453 and 454.

For the purposes of the following description, it is assumed that the piston 409 in FIG. 10 has just struck the boring tool 410 and is about to begin its return stroke.

In operation, when the signal pressure from the oscillator 406 reaches the pilot pressure chamber 429 of the spool valve 405, the spool 420 begins to move to the right and high pressure fluid is delivered to the forward cylinder chamber 413 via ports 434 and 436, line 437 and port 416. At this time, the rear cylinder chamber 414 is unloaded via port 421, lines 441 and 439, ports 438 and 452 and line 454. Accordingly, the fluid inside of the rear cylinder chamber 414 is discharged into the tank and the piston 409 is caused to return to the right.

When the piston 409 has been pushed back to a certain extent, its step part 411 reaches the port 418 thereby causing the forward cylinder chamber 13 to be connected to the rear cylinder chamber 414. Accordingly, fluid flows from the forward cylinder chamber 414 to the rear cylinder chamber 414 via port 418, lines 448 and 446, check valve 404, lines 450 and 444 and port 423. Until port 421 is closed by the step part 412 of the piston 409, the fluid is discharged from the port 421 into the tank 408 via the spool valve 405. When the port 421 is closed, the action of the clock valve 403 causes a high pressure to be present in both the forward cylinder chamber 413 and the rear cylinder chamber 414. Such that the force causing the piston 409 to return is nullified. However, the piston 409 continues to move to the right due to its own inertia and the fluid expelled from the rear cylinder chamber 414 is pushed into the accumulator 402. The accumulator 402 absorbs the shock occuring at the end of the piston stroke and stores the kinetic energy of the piston 409 in the form of potential energy. Furthermore, since ports 417, 418, 419, 420, 421 and 422 can be selectively opened and closed by means of plugs, the action of the accumulator 402 and the time at which the force from the piston returns is nullified and can be adjusted to suit the operating conditions of the piston 409.

When the signal from the oscillator 406 changes such that the pilot pressure reaches the pilot pressure chamber 430 of the spool valve 405 via line 432, the spool 405 moves to the left and high pressure fluid from pump 407 is delivered to the rear cylinder chamber 414 via the spool valve 405. Since the forward cylinder chamber is unloaded at this time, the piston 409 begins its impulse stroke. During the short interval immediately following the beginning of the impulse stroke, the pressure inside the accumulator 402 is greater than the pressure delivered by the pump 407. Accordingly, the fluid which has been accumulated inside the accumulator 402 is discharged into the rear cylinder chamber 414 in a rapid surge and the piston 409 is abruptly accelerated. After the pressure inside the accumulator 402 and the pressure delivered by the pump is equalized, the piston 409 is caused to advance by the force rising entirely from the pressure delivered by the pump 407 and finally strikes the boring tool 410. By repeating the above, the piston 409 delivers successive blows to the boring tool 410.

Figure 13:
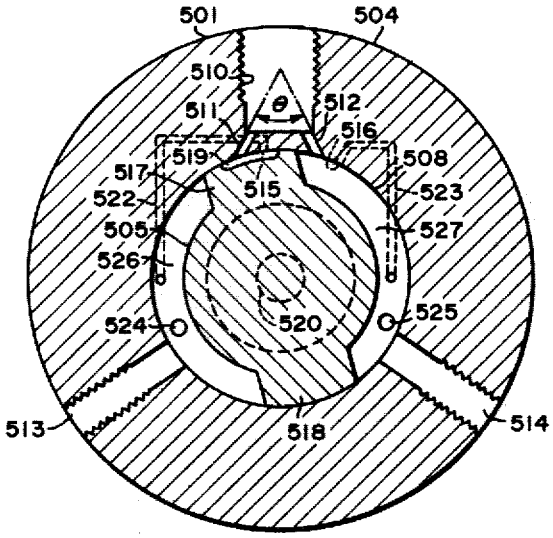
FIG. 13 is a cross sectional view of a hydraulic breaker along the lines XIII—XIII in FIG. 12.
Figure 14:
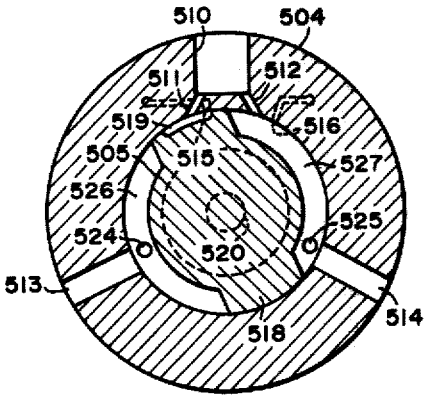
FIGS. 14 through 17 illustrate the operation of the embodiment of FIG. 12.

Referring to FIGS. 13 and 14 shown therein is a seventh embodiment of a hydraulic braker and an oscillator as the source of pilot pressure. The hydraulic impulse device consist of an oscillator 501, a hydraulic pressure amplifier 502 and an output device 503.

The oscillator 501 includes a frame 504, an oscillating part 505, a cover 506 and bearings 507. A disc shaped cylinder 508 and cylindrical bearing 509 are provided in the open side of frame 504. Furthermore, a cylindrical feed channel 510 is provided so that its axis runs from the circumference of frame 504 towards the cylinder 508. In addition, two holes which connect the feed channel 510 with the cylinder 508 are provided at predetermined angle of divergence $\sigma$ so that the ends of the holes are separated from each other and the holes are made so as to serve as feed ports 511 and 512. Discharge ports 513 and 514 are provided in symmetrical relationship in the opposite side of the cylinder 508 from the feed ports 511 and 512. Also, pilot pressure ports 515 and 516 are provided in positions located in the same direction and at a fixed angle $\sigma_1$ including $\sigma_1$ equals zero) from the feed ports 511 and 512 on a line around the circumference of the cylinder 508.

The oscillating part 505 is a disc shaped part which is smaller in diameter than the cylinder 508. Two blocking projections 517 and 518 which are in sliding contact with the interior surface of the cylinder 508 are provided in opposite positions on the circumference of the oscillating part 505. In addition, a hollow space which serves as an oil channel 519 is formed in the end surface of the blocking projection 517 on the feed port side of the oscillating part 505. A shaft 520 is formed as an integral part of the oscillating part 505. A shaft 520 is formed as an integral part of the oscillating part 505 so that it projects above and below the oscillating part 505.

A cylindrical bearing 521, lines 522 and 523 which connect the pilot pressure ports 515 and 516 with the hydraulic pressure amplifier 502 and projecting limiters 524 and 525 which regulate the position of the oscillating part 505 when it is at rest are all provided in the cover 506. The oscillating part 505 is supported by means of bearings 507 such that it is free to rotate with respect to the frame 504 and the cover 506 which is inserted into the frame 504. The oscillating part 505 together with the cylinder 508 form respectively two ring shaped pressure chambers 526 and 527. Furthermore, in order to regulate the position of the oscillating part 505 when it is at rest, the blocking projecting 518 on the discharge side of the oscillating part 505 is positioned such that it is between the limiters 524 and 525.

The hydraulic pressure amplifier 502 consist of a frame 530, a spool 531, springs 532 and adjusting screw 533. The spool 531 which has cylindrical lands 535, 536 and 537 at both ends and in the middle is inserted along with springs 532 into a cylinder 534 provided in frame 530 and is held in place by the adjusting screw 533. Furthermore, lines 522 and 523 which respectively couple the left chamber 538 and the right chamber 539 of the cylinder 534 with the pilot pressure ports 515 and 516 of the oscillator 501, are provided in the frame 530. In addition, a discharge line 540 which is coupled with cylinder 534 at points between the spool lands 535 and 536 and between the spool lands 535 and 536 and between the spool lands 535 and 536 and between 536 and 537, high pressure feed line 541 which is coupled with the central portion of cylinder 534 and lines 542 and 543 which couple the output device 503 with the cylinder 534 at points between the spool lands 535 and 536 and between the spool lands 536 and 537 are all provided in the frame 530.

The output device 503 comprises a frame 550 and a piston 551 which strikes the boring tool. The piston is provided within cylinder 552 such that it can slide back and forth. Furthermore, left chamber 545 and right chamber 555 and cylinder 552 are coupled with cylinder 534 of the hydraulic pressure amplifier 502 via lines 542 and 543.

Figure 15:
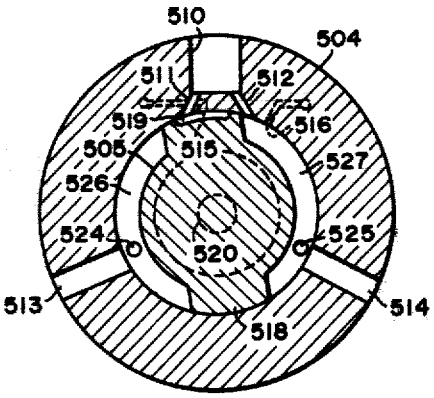
Figure 16:
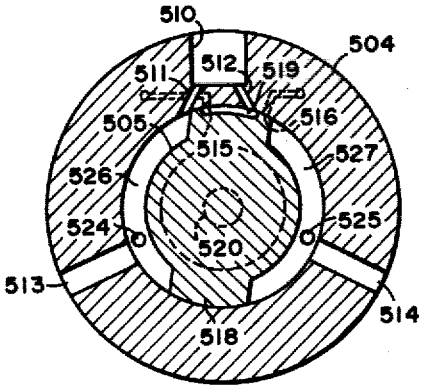
Figure 17:
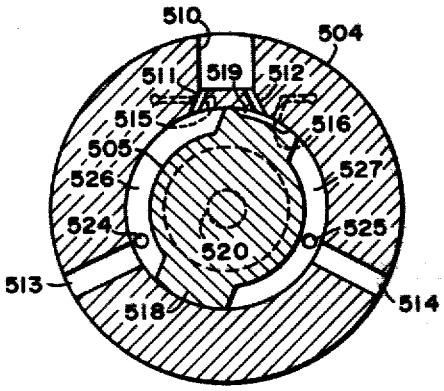

Assume for the purpose of the following description that the oscillating part 505 is in the position shown in FIG. 14. In operation, the oil delivered under pressure from feed channel 510 of the oscillator 501 flows into the right ring shaped pressure chamber 527 from the right feed port 512 and is discharged via the discharge port 514. At this time, the hydraulic pressure acting on the block projecting 518 of the oscillating part 505 causes the oscillating part 505 to rotate in a clockwise direction such that it passes through the position shown in FIG. 15 and reaches the position shown in FIG. 16. In the position shown in FIG. 16, the oscillating part 505 no longer receives a force which causes it to rotate in a clockwise direction. However, the oscillating part 505 continues to rotate in a clockwise direction until the energy required during its movement from the direction shown in FIG. 15 to the position shown in FIG. 16 is completely dissipated by the resistance of the oil and by the force which acts on the oscillating part 505 in a clockwise direction rising from the oil which flows in from the left feed port 511. Accordingly, the oscillating part stops when it reaches the position shown in FIG. 17. In the position shown in FIG. 17, the only hydraulic pressure delivered by the left feed port 511 acts on the blocking projecting 518 of the oscillating part 505. Therefore, the oscillating part 505 reverses its previous motion and rotates in a counterclockwise direction such that it passes through the position in FIG. 16 and FIG. 15 and returns to the position shown in FIG. 14. By repeating the above described movements, the oscillating part 505 continues its repetitive rotation oscillating without contacting the limiters 525 and 525.

When oil is delivered under pressure to the oscillator 501 such that the oscillating part 505 is caused to oscillate in the manner described above, the pilot pressure ports 515 and 516 each are alternately connected with the oil channel 519 in the blocking projection 517 and with one of the ring shaped pressure chambers 525 and 526. Accordingly, there is alternately generated in each pilot pressure chamber a high pressure which is approximately equal to the feed pressure and a low pressure which is approximately equal to the back pressure in the ring shaped pressure chamber involved. In this embodiment of the oscillator 501, the pilot pressure ports 515 and 516 are each located at an angle $\sigma_l$ in a clockwise direction from the ports 511 and 512. In the pilot pressure port 516, therefore, the period of time during which high pressure is maintained is shorter than the period of time which a low pressure is maintained. On the other hand, exactly the reverse is true in the other pilot pressure port 515.

The pilot pressure is transmitted to the left chamber 538 and right chamber 539 of the cylinder 534 of the hydraulic pressure amplifier 502 via lines 522 and 523. Accordingly, high and low pressure alternately act on both ends of the spool 531 of the piston switching valve and the spool 531 oscillates back and forth.

When high pressure is present in the left chamber 538 and low pressure is present in the right chamber 539 of the cylinder, the spool 531 moves to the right and oil delivered under high pressure feed line 541 flows into the left chamber 554 of the cylinder of the output device 503 via line 542. Accordingly, the piston 551 moves to the right. At this time, the oil inside the right chamber 555 of the cylinder 552 is discharged via line 543, spool cylinder 534 and discharge line 540.

In addition, when the pilot pressure is switched such that high pressure is present in the right chamber 539 and low pressure is present in the left chamber 538 of the cylinder 534, the spool 531 moves to the left. Under these conditions, oil is delivered in a high pressure to the right chamber 535 of the cylinder 552 of the output device 503 via spool cylinder 534 and line 543. Accordingly, the piston 551 moves to the left. At this time, the oil inside the left chamber 554 of the cylinder 552 is discharged via line 542 on a spool cylinder 534 discharge line 540. Thus, the piston 551 of the output device 503 delivers successive blows to the boring tool in accordance with the period of the oscillating pilot pressure obtained from the oscillator 501. In this embodiment the period of time during which high pressure is maintained in the right pilot pressure port 516 is shorter than that maintained in the left pressure port 515. Accordingly, the duration of the impulse stroke is shorter than the duration of the return stroke.

Figure 18:
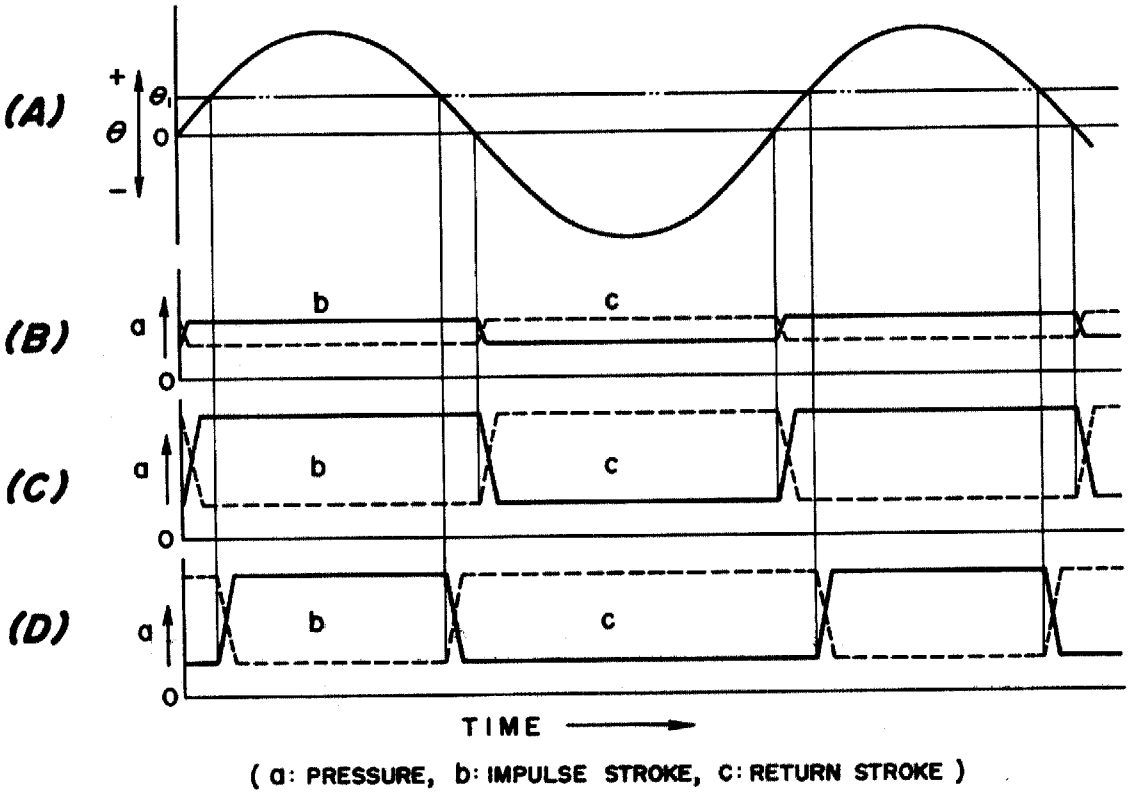
FIG. 18 is a time chart illustrating the relationship between the pilot pressure and the position of the oscillating part of the device for generating oscillating pressure utilized in the embodiment of FIG. 12.

FIG. 18 is a time chart which illustrates the relative relationship between the position of the oscillating part 505 and the stroke of the piston which strikes the boring tool. The horizontal axis represents time and the vertical axis represents respectively (a) the angle of rotation $\sigma$ of the oscillating part 505 (clockwise rotation of the oscillating part 505 from a neutral position is shown as positive whereas a counter clockwise rotation is shown as negative) and (b) the pilot pressure acting on the cylinder of the piston switching valve (the pressure acting on the left Chamber 538 of the cylinders is expressed as a broken line while the pressure acting on the right chamber 539 is expressed as a solid line).

In this embodiment, pilot pressure ports are located at an angle $\sigma_l$ in a clockwise direction from the feed ports. Accordingly, the duration of the return stroke of the piston is longer than that of the impulse stroke (as shown in FIG. 18D). FIG. 18B indicates the result of using a convention device for generating oscillating pressure. As shown in FIG. 18B the pilot pressure acts on the left chamber 538 and the right chamber 539 of the cylinder for equal periods of time and there is only a small amount of variation in the pilot pressure.

Figure 19:
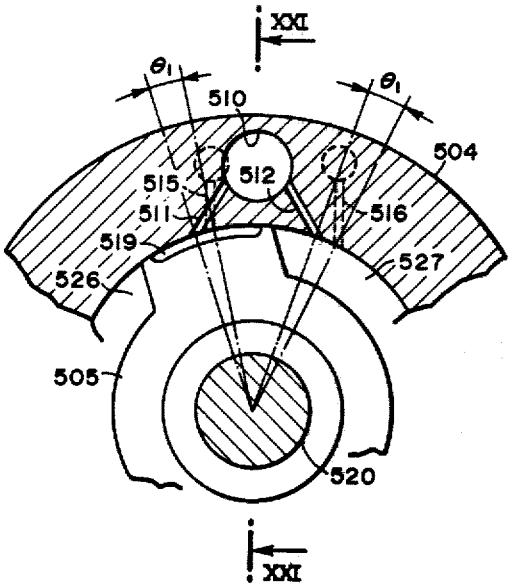
FIG. 19 is a plan view of a second embodiment of a means for generating oscillating pressure utilized in the embodiment of FIG. 12.
Figure 21:
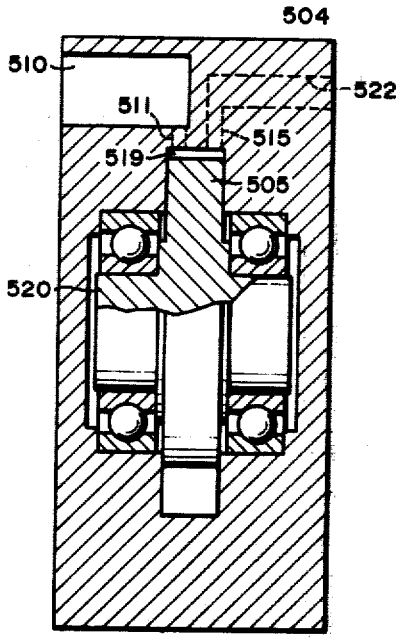
FIG. 21 is a cross sectional view of the embodiments of FIGS. 19 and 20 along the lines XI—XI in FIGS. 19 and 20.
Figure 20:
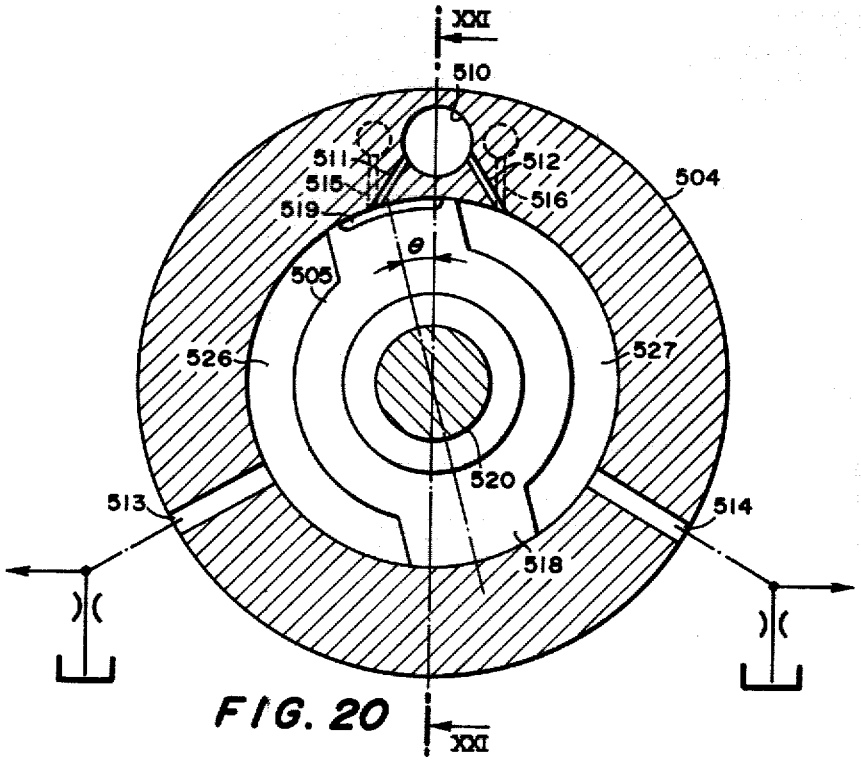
FIG. 20 is a plan view of a third embodiment of a device for generating oscillating pressure utilized in the embodiment of FIG. 12.

In this embodiment, the feed channel 510 is installed in the form of a cylinder channel oriented so that its axis run from the circumference of the frame 504 towards the center of cylinder 508. However, FIGS. 19 through 21 illustrate an embodiment of the oscillator 501 in which the feed channel is installed so that its axis is parallel to the axis of the cylinder. In addition, while in the first embodiment $\sigma_l$ could not equal zero, the embodiment illustrated in FIGS. 20 and 21 is an embodiment wherein $\sigma_l$ equals zero. In this case, the duration of the impulse stroke and the duration of the return stroke is equal as illustrated by the relationship between the pilot pressure and the position of the oscillating part as shown in FIG. 7C. In all other ways the embodiment of FIGS. 19 through 21 is the same as that previously described.

As described above, the oscillator 501 provided by this invention makes it possible to generate a pilot pressure in which the period of time during which the high pressure is maintained is different from the period of time during which a low pressure is maintained. Accordingly, the time required for reciprocating motion of the piston can be adjusted with optimum value for use in percussion machinery such as hydraulic rock drills, hydraulic breakers, etc. As a result, the energy of the piston can be transmitted to the rock with a high degree of efficiency and the idle time (the time during which the piston is in contact with the boring tool but is not performing any work) can be reduced. Furthermore, this invention is used in rotary percussion drills in which the bit is caused to revolve by means of a motor, etc., the bit abrasion can be vented. In addition, since this invention is able to generate a pilot pressure on which the pressure variation is quite large, it possess the addition superior method of being able to function as a high output actuator.

It should be apparent to one skilled in the art that the above described embodiments are merely illustrative of but a few of the many possible specific embodiments which represent the applications and principles of the present invention. Numerous and varied other arrangements can be readily devised in those skilled in the art without departing from the spirit and scope of the invention.

We claim:

1. An oscillator actuated hydraulic impulse device of the type including a spool valve actuated by an alternating signal from an oscillator to switch the hydraulic pressure in a double-acting cylinder in order to cause reciprocating motion of a piston which strikes a boring tool and the frequency of the oscillator is independent of the movement or position of the piston, said hydraulic impulse device being characterized by:

a rear end port provided in a rear chamber of said cylinder;

an accumulator coupled to said rear end port;

a flow line coupling said rear end port to a source of hydraulic fluid;

a check valve provided in said flow line;

a plurality of mid-point ports for controlling a transistion of said piston from an impulse stroke to a return stroke provided in said rear chamber further toward the midpoint of said cylinder than said rear end port which are opened and closed by movement of said piston; and a further flow line coupling said plurality of mid-point ports to said spool valve.

2. A hydraulic impulse device comprising:

a cylinder;

a differential piston provided in said cylinder and together with said cylinder forming a forward and rear chamber, said piston further being configured such that the area of said piston in said forward chamber is larger than the area of said piston in said rear chamber;

a means for supplying a constant hydraulic pressure to said rear chamber;

an oscillator whose frequency is independent of the movement or position of said piston;

a first means for generating a signal indicative of the changed position of said piston; and a spool valve for switching hydraulic pressure into said forward chamber whereby reciprocating motion of said piston for striking a boring tool is created, said spool valve being activated in response to said oscillator and said first means.

3. A hydraulic impulse device according to claim 2 wherein the ratio of the piston area in said forward chamber to the piston area in said rear chamber is greater than one but less than two.

4. A hydraulic impulse device according to claim 2 wherein said first means comprises:

a port provided in said cylinder, said port being provided in said cylinder such that said port opens at the end of an impulse stroke of said piston;

a flow line coupling said port to said spool valve; and a variable throttle valve provided in said flow line whereby the actuation time of said spool valve may be varied by varying said variable throttle.

5. A hydraulic impulse device according to claim 2 wherein said first means comprises:

a plurality of ports provided in said rear chamber of said cylinder along the line of movement of said piston, each of said ports being coupled to said spool valve; and means for selectively opening and closing each of said plurality of ports whereby the actuation timing of said spool valve can be varied by selectively opening and closing said plurality of ports.

6. A hydraulic impulse device comprising:

a reciprocatable piston having an impulse stroke and a return stroke for striking a boring tool;

an oscillator having a variable oscillating frequency which is independent of the movement or position of said reciprocatable piston for generating an alternating signal;

a means for sensing a position of said reciprocatable piston and which generates a stroke signal when said reciprocating piston completes its impulse stroke; and a spool valve responsive to said alternating signal and said stroke signal for causing said reciprocatable piston to reciprocate whereby the transistion from said impulse stroke to said return stroke is controlled and a duration of said impulse stroke and said return stroke can be varied.

* * * * *